US011209221B2

(12) United States Patent
Spangler et al.

(10) Patent No.: US 11,209,221 B2
(45) Date of Patent: Dec. 28, 2021

(54) MODIFIED SHAPED HEAT EXCHANGER INLETS/OUTLETS

(71) Applicant: Raytheon Technologies Corporation, Farmington, CT (US)

(72) Inventors: Brandon W. Spangler, Vernon, CT (US); David R. Pack, Ellington, CT (US); William P. Stillman, Ashford, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 36 days.

(21) Appl. No.: 16/854,661

(22) Filed: Apr. 21, 2020

(65) Prior Publication Data

US 2021/0325129 A1 Oct. 21, 2021

(51) Int. Cl.
*F28F 9/02* (2006.01)
*F28F 1/04* (2006.01)

(52) U.S. Cl.
CPC . *F28F 9/02* (2013.01); *F28F 1/04* (2013.01)

(58) Field of Classification Search
CPC ..... F28F 9/02; F28F 1/04
USPC ..... 165/173
See application file for complete search history.

(56) References Cited

U.S. PATENT DOCUMENTS 4,524,823 A 6/1985 Hummel et al.
8,020,612 B2 9/2011 Wegner
2012/0012291 A1 1/2012 Ito et al.
2012/0049665 A1* 3/2012 Garriga ..... F16C 35/042 310/54
2015/0285569 A1* 10/2015 Glenn ..... F28F 9/02 165/173
2019/0249935 A1 8/2019 Dziubinschi et al.

FOREIGN PATENT DOCUMENTS

EP 1903207 A1 3/2008
EP 3396294 A1 10/2018
WO 2017052798 A1 3/2017
WO 2017165921 A1 10/2017
WO 2018194457 A1 10/2018

OTHER PUBLICATIONS

EP Search Report dated Sep. 20, 2021 issued for corresponding European Patent Application No. 21169740.4.

* cited by examiner

*Primary Examiner* — Davis D Hwu
(74) *Attorney, Agent, or Firm* — Bachman & LaPointe, P.C.

(57) ABSTRACT

A modified shaped heat exchanger hot air inlet and hot air outlet comprising a first heat exchanger manifold surrounding said hot air inlet and a second heat exchanger manifold surrounding said hot air outlet; an array of shaped inlets and shaped outlets, each of said shaped inlets and shaped outlets being configured to align vertices with thermal load directions responsive to a thermal expansion mismatch between the hot air inlet and hot air outlet and respective first heat exchanger manifold and second heat exchanger manifold.

20 Claims, 4 Drawing Sheets

MODIFIED SHAPED HEAT EXCHANGER INLETS/OUTLETS

BACKGROUND

The present disclosure is directed to heat exchangers with modified hot side inlets and outlets, and more particularly hot side inlets and outlets with specialized shapes configured to align load directions proximate to the manifold.

Heat exchangers with rectangular inlets and outlets on the hot side of the heat exchanger have been cast, creating a stiff box like structure. The inlet and outlet regions of the heat exchanger are surrounded by a manifold that delivers the hot air to and from the heat exchanger. The outside of the manifold is surrounded by cold bypass air that also goes through the cold side of the heat exchanger. This cold air on the outside of the manifold causes the manifold to heat up slower than the inlets and outlets of the heat exchanger, which are surrounded entirely by hot air. Thus, a thermal fight between the hot inlets and the colder manifold is created, causing high compressive stress in the stiff boxlike structure of the rectangular inlets. Since the inlets and outlets of the heat exchanger are the regions of the heat exchanger that are surrounded by and constrained by the colder manifold, the stress is focused at the inlet and outlet regions of the heat exchanger. Because the main portion of the heat exchanger is not constrained by the manifold, it is free to expand and therefore experiences minimal stress.

What is needed is a modified shape for the heat exchanger inlets and outlets proximate the manifold.

SUMMARY

In accordance with the present disclosure, there is provided a modified shaped heat exchanger hot air inlet and hot air outlet comprising a first heat exchanger manifold surrounding the hot air inlet and a second heat exchanger manifold surrounding the hot air outlet; and a shaped array of a shaped inlet and a shaped outlet, each of the shaped inlet and shaped outlet being configured to align vertices with thermal load directions responsive to a thermal expansion mismatch between the hot air inlet and hot air outlet and respective first heat exchanger manifold and second heat exchanger manifold.

A further embodiment of any of the foregoing embodiments may additionally and/or alternatively include the first heat exchanger manifold and second heat exchanger manifold constrain the thermal expansion of the hot air inlet and hot air outlet respectfully.

A further embodiment of any of the foregoing embodiments may additionally and/or alternatively include the modified shaped heat exchanger hot air inlet and hot air outlet further comprising a first hot side transition region between the hot air inlet and heat transfer channels, the first hot side transition region configured as a smooth gradual cross sectional area transition to the heat transfer channels; and a second hot side transition region between the hot air outlet and the heat transfer channels, the second hot side transition region configured as a smooth gradual cross sectional area transition to the heat transfer channels.

A further embodiment of any of the foregoing embodiments may additionally and/or alternatively include the heat transfer channels have a rectangular cross sectional flow area.

A further embodiment of any of the foregoing embodiments may additionally and/or alternatively include the shaped hot air inlet comprises a star shaped hot air inlet and the shaped hot air outlet comprises a star shaped hot air outlet; the star shaped hot air inlet and the star shaped hot air outlet are configured to align secondary vertices with the thermal load directions in a corner of the heat exchanger.

A further embodiment of any of the foregoing embodiments may additionally and/or alternatively include the shaped hot air inlet comprises a star shaped hot air inlet and the shaped hot air outlet comprises a star shaped hot air outlet; the star shaped hot air inlet and star shaped hot air outlet are configured to align primary vertices with the thermal load directions in a corner of the heat exchanger.

A further embodiment of any of the foregoing embodiments may additionally and/or alternatively include the shaped hot air inlet comprises a star shaped hot air inlet; and a diamond shaped hot air inlet situated proximate to the star shaped hot air inlet; and the shaped hot air outlet comprises a star shaped hot air outlet; and a diamond shaped hot air outlet situated proximate to the star shaped hot air outlet.

In accordance with the present disclosure, there is provided a modified shaped heat exchanger inlet and outlet comprising a hot side of the heat exchanger configured to flow hot air from a hot air inlet through heat transfer channels to a hot air outlet; a first manifold surrounding the hot air inlet forming a first cavity and a second manifold surrounding the hot air outlet forming a second cavity; a cold side of the heat exchanger including cold side heat transfer passageways thermally coupled to the heat transfer channels, the cold side heat transfer passageways configured to flow cold air over the heat transfer channels; and a shaped inlet at the hot air inlet and a shaped outlet at the hot air outlet, the shaped inlet and the shaped outlet being configured to align vertices with thermal load directions responsive to a thermal expansion mismatch between the hot air inlet and the first manifold and hot air outlet and the second manifold.

A further embodiment of any of the foregoing embodiments may additionally and/or alternatively include the modified shaped heat exchanger inlet and outlet further comprising a first hot side transition region between the hot air inlet and heat transfer channels; and a second hot side transition region between the hot air outlet and the heat transfer channels.

A further embodiment of any of the foregoing embodiments may additionally and/or alternatively include the shaped hot air inlet comprises at least one of a star shaped and diamond shaped hot air inlet and the shaped hot air outlet comprises at least one of a star shaped and a diamond shaped hot air outlet.

A further embodiment of any of the foregoing embodiments may additionally and/or alternatively include the star shape is configured to align secondary vertices with the thermal load direction in a corner of the heat exchanger; and wherein the star shape is configured to align primary vertices with the thermal load direction at a center of the first manifold wall and with the thermal load direction at a center of the second manifold wall.

A further embodiment of any of the foregoing embodiments may additionally and/or alternatively include the modified shaped heat exchanger inlet and outlet further comprising a diamond shaped inlet situated proximate the star shaped inlet, and a diamond shaped outlet situated proximate the star shaped outlet.

A further embodiment of any of the foregoing embodiments may additionally and/or alternatively include a star shaped inlet at the hot air inlet and a star shaped outlet at the hot air outlet, are configured to align flexible vertices, including primary vertices and secondary vertices, with the thermal load directions thereby enabling the first cavity and second cavity to distort, changing the shape of the first cavity and the second cavity.

In accordance with the present disclosure, there is provided a process for creating a flexible heat exchanger inlet and outlet comprising surrounding a hot air inlet with a first manifold; surrounding a hot air outlet with a second manifold; forming an array of shaped inlets at the hot air inlet; forming an array of shaped outlets at the hot air outlet; and aligning a vertices direction of the shaped inlets and the shaped outlets with a thermal load direction, the thermal load being responsive to a thermal expansion mismatch between the hot air inlet and the first manifold and a thermal expansion mismatch between the hot air outlet and the second manifold.

A further embodiment of any of the foregoing embodiments may additionally and/or alternatively include the array of shaped inlets at the hot air inlet comprises at least one of a star shaped and diamond shaped hot air inlet; and the array of shaped outlets at the hot air outlet comprises at least one of a star shaped and a diamond shaped hot air outlet.

A further embodiment of any of the foregoing embodiments may additionally and/or alternatively include the process further comprising coupling a first hot side transition region between the hot air inlet and heat transfer channels; and coupling a second hot side transition region between the hot air outlet and the heat transfer channels.

A further embodiment of any of the foregoing embodiments may additionally and/or alternatively include the process further comprising aligning secondary vertices with the thermal load directions in a corner of the heat exchanger.

A further embodiment of any of the foregoing embodiments may additionally and/or alternatively include the process further comprising forming at least one star shaped inlet within the array of shaped inlets; forming at least one star shaped outlet within the array of shaped outlets; forming at least one diamond shaped inlet proximate the at least one star shaped inlet; and forming at least one diamond shaped outlet proximate the at least one star shaped outlet.

A further embodiment of any of the foregoing embodiments may additionally and/or alternatively include the process further comprising aligning primary vertices with the thermal load directions.

A further embodiment of any of the foregoing embodiments may additionally and/or alternatively include the process further comprising changing the shape of a first cavity formed by the first manifold surrounding the hot air inlet by allowing the first cavity to distort while the vertices align with the thermal load directions; and changing the shape of a second cavity formed by the second manifold surrounding the hot air outlet by allowing the second cavity to distort while the vertices align with the thermal load directions.

The disclosed heat exchanger modification to the inlets and outlets replaces the rectangular inlets and outlets with a staggered array of diamond or star shaped inlets and outlets. The diamond/star shape inlets/outlets result in the flexible vertices being aligned with the compressive thermal load directions caused by the colder manifold, allowing the ribs of the heat exchanger hot side inlets to expand and deform with minimal stress. At the location where the manifold stops constraining the heat exchanger, a transition region begins where the diamond/star shaped inlets transition shape back to the rectangular heat exchanger hot side channels to allow room for the cold side passages.

Other details of the modified shape heat exchanger inlets/outlets are set forth in the following detailed description and the accompanying drawings wherein like reference numerals depict like elements.

DETAILED DESCRIPTION

Figure 1:
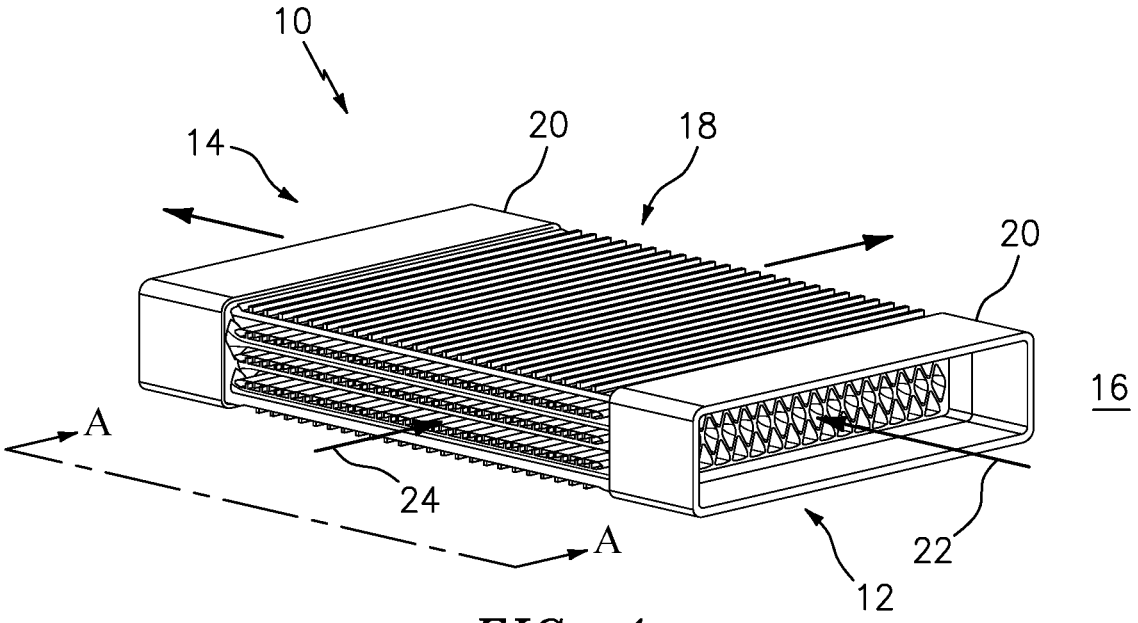
FIG. 1 is an isometric schematic diagram of an exemplary heat exchanger.
Figure 2:
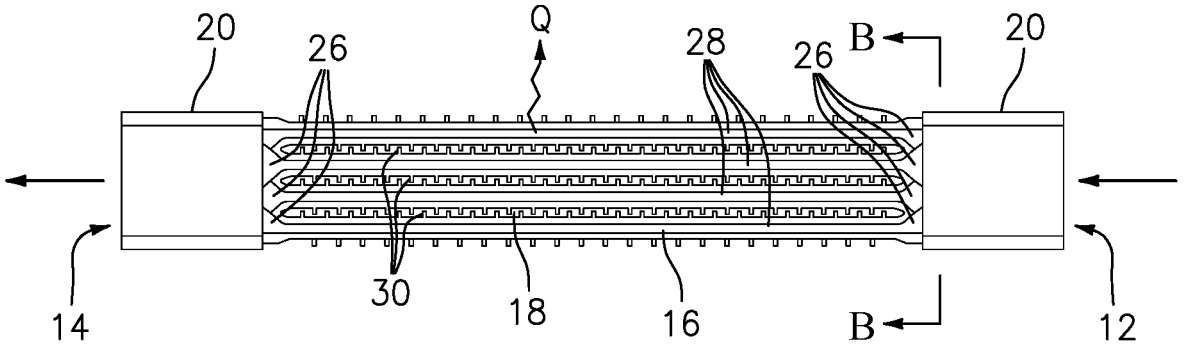
FIG. 2 is a view through cut A-A of the exemplary heat exchanger of FIG. 1.

Referring to FIG. 1 and FIG. 2, an exemplary heat exchanger 10 is shown. The heat exchanger 10 includes a hot air inlet 12 and a hot air outlet 14 opposite each other, the inlet 12 and outlet 14 are configured for a hot side 16 of the heat exchanger 10. A cold side 18 of the heat exchanger 10 is thermally coupled to the hot side 16. The hot air inlet 12 and hot air outlet 14 are both surrounded by a manifold 20 that is configured to deliver the hot air 22. Cold air 24 flows through the cold side 18 to receive thermal energy Q from the hot air 22 flowing through the hot side 16. The heat exchanger 10 also includes hot side transition regions 26 between the hot air inlet 12 and hot side heat transfer channels 28 as well as between the hot air outlet 14 and hot side heat transfer channels 28. The transition regions 26 from the inlets act as bell mouth inlets with relatively larger cross sectional area than the rectangular cross section in the heat transfer channels 28 resulting in a lower pressure drop. The transition regions 26 allow for a smooth gradual cross sectional area transition to the rectangular cross section. In an exemplary embodiment, the hot side heat transfer channels 28 have a rectangular cross section in order to maximize flow area of the cold side heat transfer passages 30. In other exemplary embodiments, the cross section can be configured to maximize the flow area of the hot side and cold side flow of air. The heat transfer channels 28 can be staggered to match the inlets 12 and outlets 14. The heat exchanger 10 portions between the manifolds 20 are not constrained by the manifold and can be square shaped, since no effective compressive stress loads are created in that region.

Figure 3:
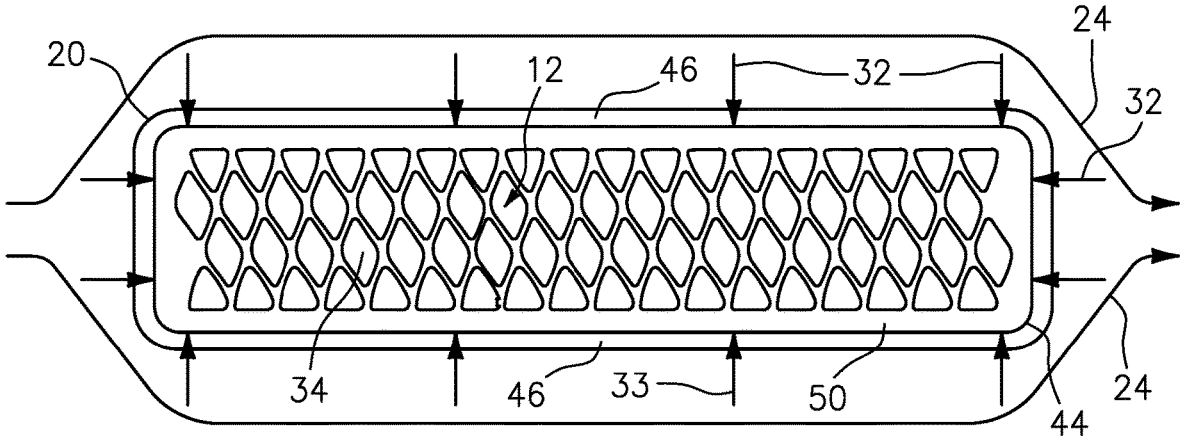
FIG. 3 is a view through cut B-B of the exemplary heat exchanger of FIG. 2.

As seen in FIG. 3, the manifold 20 constrains the expansion of the hot air inlet 12 and hot air outlet 14. The manifold 20 heats up slower than the hot air inlet 12 and hot air outlet 14 due to the cooling influence of the cold air 24 flowing over the manifold 20. As a result of the mismatch between the manifold 20 and hot air inlet 12 and hot air outlet 14, thermal expansion of the hot air inlet 12 and hot air outlet 14 is more rapid than the manifold 20 creating thermal loads and stress caused by the mismatched expansion. The size and orientation of the thermal loads 32 can vary based on the location within the hot air inlet 12 and hot air outlet 14, as well as the size and shape of the manifold 20. For instance, at the center 46 of the manifold walls 50, the mismatch in thermal expansion between the manifold 20 and hot air inlet 12 and hot air outlet 14 can cause compressive thermal loads 33. Since the thermal expansion of the hot air inlet 12 and hot air outlet 14 can cause long unsupported lengths of the manifold walls 50 to bulge at the center 46 while the corners 44 of the manifold walls 50 remain constrained, the compressive loads 33 may be less at the center 46 and increasing towards the corners 44. Moreover, the combination of a cold manifold 20 perimeter and bulging of the manifold wall 50 at the center 46 can result in high corner compression loads 45 in the heat exchanger 10 inlet 12 corners 44 that are at an angle relative to the compressive loads 33. Whereas, the combination of corner compression loads 45 and bulging of the manifold 20 wall at the center 46 can result in high tensile loads 48 near the corners 44 that are perpendicular to the corner compression loads 45, see FIG. 5 and FIG. 6.

Figure 4:
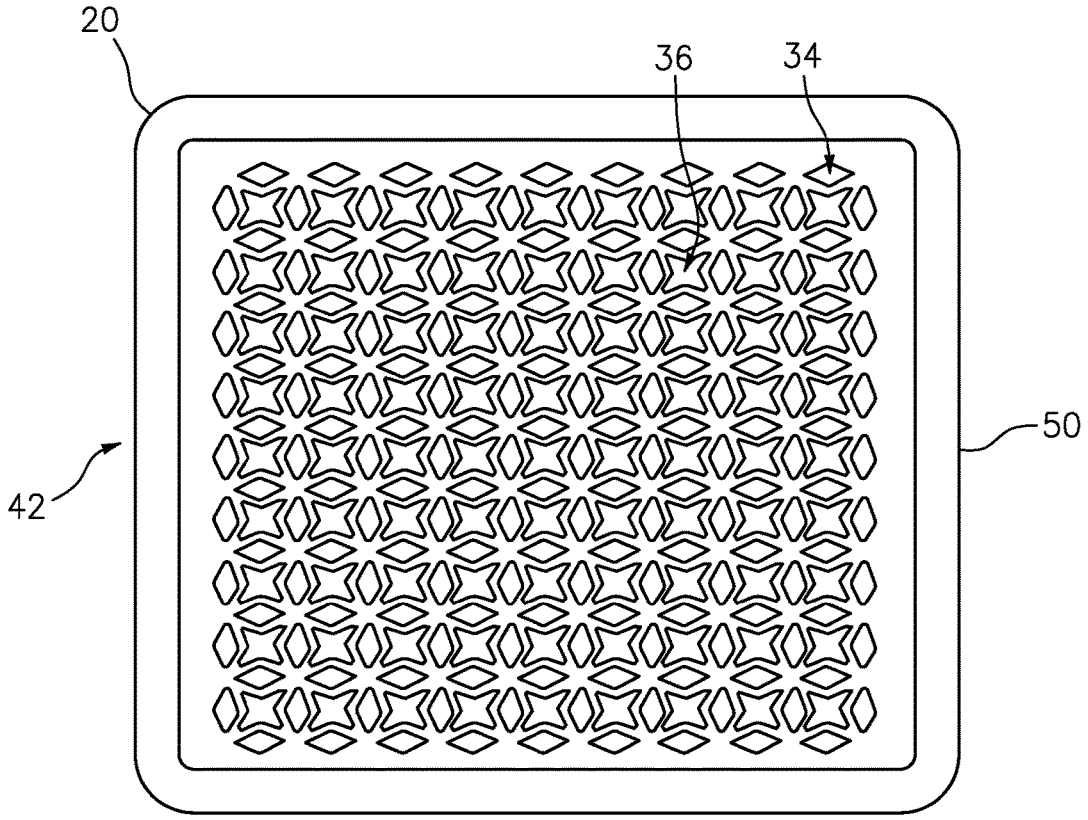
FIG. 4 is a view through cut B-B of another exemplary heat exchanger of FIG. 2.
Figure 5:
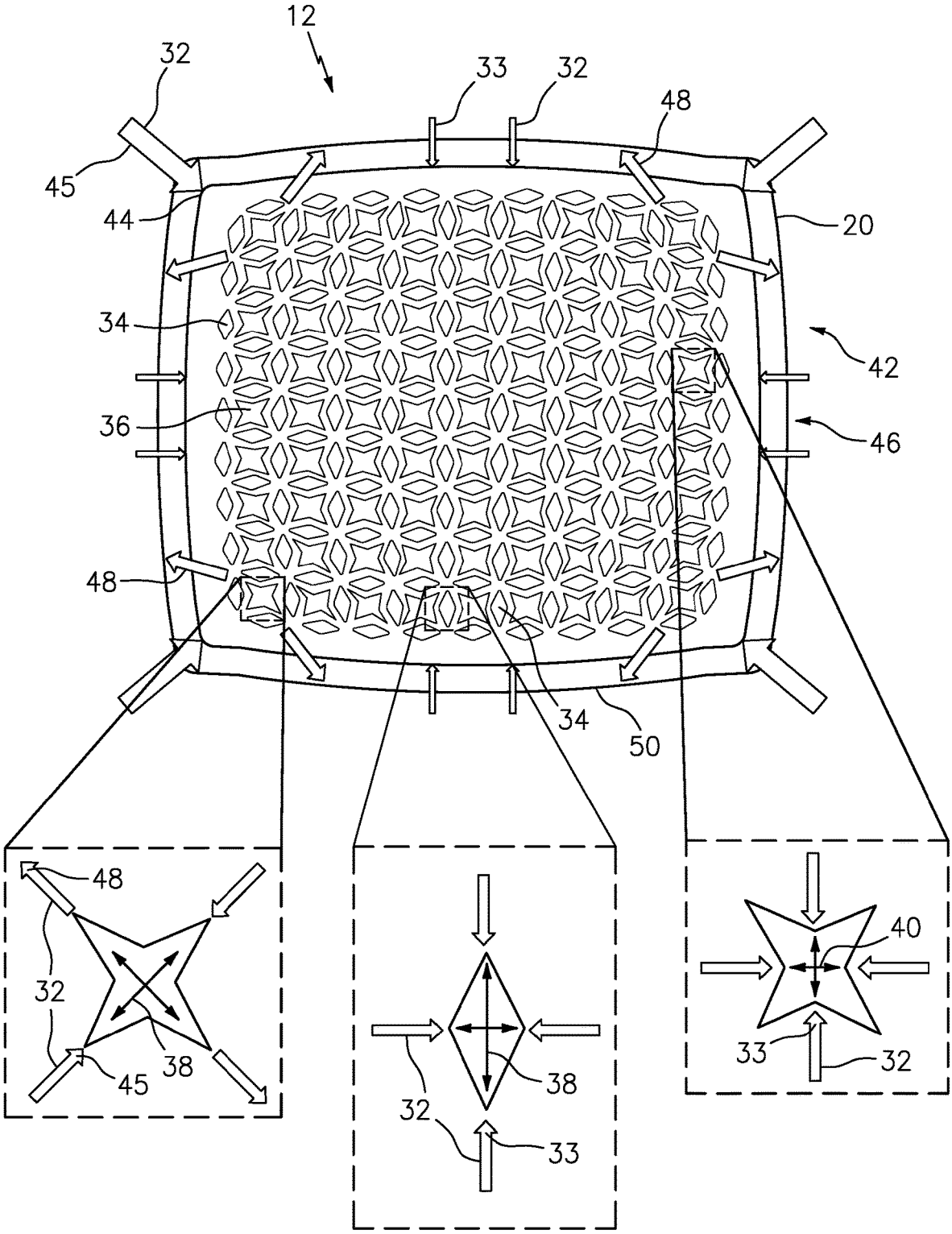
FIG. 5 is a schematic diagram with a view through cut B-B of an exemplary heat exchanger in a hot state including exploded view details.
Figure 6:
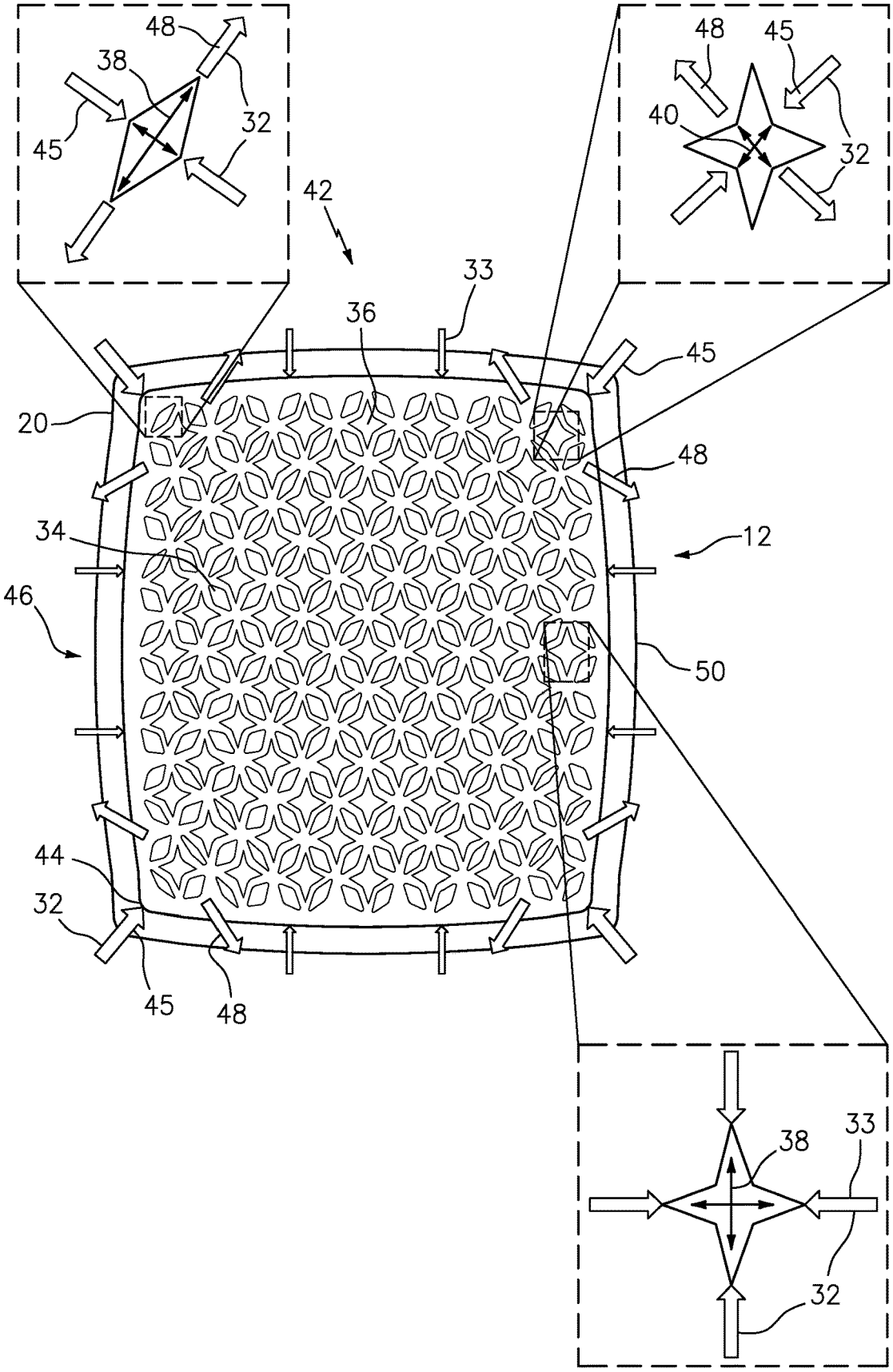
FIG. 6 is a schematic diagram with a view through cut B-B of an exemplary heat exchanger in a hot state including exploded view details.

Referring also to FIG. 4, FIG. 5 and FIG. 6, the exemplary heat exchanger hot air inlet 12 and hot air outlet 14 are shown in cross section through cut B-B of FIG. 2. The inlet 12 and outlet 14 are configured with a shaped array, more specifically an array in a diamond shape 34 and/or star shape 36. The shaped array, i.e., diamond shape 34 and/or star shape 36 inlets 12 and outlets 14 provide for flexible vertices, including primary vertices 38 and secondary vertices 40 that can align with the thermal loads 32. When the orientation of the vertices 38, 40 align with the thermal loads 32, the overall structure becomes more flexible and can distort, changing the shape of the cavity 42 of the inlet 12 and outlet 14, thus minimizing the stresses. The fight between the expansion of the hot structure of the hot air inlet 12, hot air outlet 14 and the cold structure of the manifold 20 can be taken up by the distortion of the cavity 42. The prior structures having rectangular inlets/outlets, in contrast to the disclosed structure, aligned the loads with the walls 50 of the cavity 42 instead of the vertices 38, 40, resulting in the high stress. As can be seen in FIGS. 3, 4, 5, and 6, the disclosed structures allow for the diamond shape 34 and/or star shape 36 to align the primary vertices 38 with some of the thermal loads 32. The star shape 36 also includes secondary vertices 40 that can be aligned with the thermal loads 32 in a different orientation. For instance, in FIG. 5, the primary vertices 38 of the star shape 36 are aligned with corner loads 45, 48 while the secondary vertices 40 are aligned with the compressive loads 33. Whereas, in FIG. 6, the primary vertices 38 of the star shape 36 are aligned with the compressive loads 33 and the secondary vertices 40 aligned with the corner loads 45, 48. In an exemplary embodiment, the diamond shape 34 can be situated proximate the star shapes 36 to enable flexibility. In an exemplary embodiment, the diamond shape 34 can be located between the star shapes 36. In this configuration, as can be seen in FIGS. 5, 6, the primary vertices of the diamond shape 34 and the secondary vertices 40 of the star shape 36 are aligned.

Although the disclosure focuses on diamond and star shapes, the thermal stresses can be reduced by orienting the vertices of other shapes with the thermal loads.

A technical advantage of the disclosed heat exchanger can include aligning the orientation of the cavity vertices with the thermal loads, which makes the structure in the cavity flexible and free to distort, changing the shape of the cavity and minimizing stresses.

A technical advantage of the disclosed heat exchanger can include minimizing the stress associated with the fight between the expansion of the hot structure at the heat exchanger inlets/outlets and the cold structure at the manifold, which can be taken up by the distortion of the cavity.

A technical advantage of the disclosed heat exchanger can include the capacity of the aligned vertices to allow the heat exchanger to expand and collapse, bending with lower stress and without failure.

There has been provided modified shaped heat exchanger inlets/outlets. While the modified shaped heat exchanger inlets/outlets have been described in the context of specific embodiments thereof, other unforeseen alternatives, modifications, and variations may become apparent to those skilled in the art having read the foregoing description. Accordingly, it is intended to embrace those alternatives, modifications, and variations that fall within the broad scope of the appended claims.

What is claimed is:

1. A modified shaped heat exchanger hot air inlet and hot air outlet comprising:
   - a first heat exchanger manifold surrounding said hot air inlet and a second heat exchanger manifold surrounding said hot air outlet; and
   - a shaped array of a shaped inlet and a shaped outlet, each of said shaped inlet and shaped outlet being configured to align vertices with thermal load directions responsive to a thermal expansion mismatch between the hot air inlet and hot air outlet and respective first heat exchanger manifold and second heat exchanger manifold.

2. The modified shaped heat exchanger hot air inlet and hot air outlet according to claim 1, wherein said first heat exchanger manifold and second heat exchanger manifold constrain said thermal expansion of said hot air inlet and hot air outlet respectfully.

3. The modified shaped heat exchanger hot air inlet and hot air outlet according to claim 1, further comprising:
   - a first hot side transition region between said hot air inlet and heat transfer channels, said first hot side transition region configured as a smooth gradual cross sectional area transition to said heat transfer channels; and
   - a second hot side transition region between said hot air outlet and said heat transfer channels, said second hot side transition region configured as a smooth gradual cross sectional area transition to said heat transfer channels.

4. The modified shaped heat exchanger hot air inlet and hot air outlet according to claim 3, wherein said heat transfer channels have a rectangular cross sectional flow area.

5. The modified shaped heat exchanger hot air inlet and hot air outlet according to claim 1, wherein said shaped hot air inlet comprises a star shaped hot air inlet and said shaped hot air outlet comprises a star shaped hot air outlet; said star shaped hot air inlet and said star shaped hot air outlet are configured to align secondary vertices with the thermal load directions in a corner of the heat exchanger.

6. The modified shaped heat exchanger hot air inlet and hot air outlet according to claim 1, wherein said shaped hot air inlet comprises a star shaped hot air inlet and said shaped hot air outlet comprises a star shaped hot air outlet; said star shaped hot air inlet and star shaped hot air outlet are configured to align primary vertices with the thermal load directions in a corner of the heat exchanger.

7. The modified shaped heat exchanger hot air inlet and hot air outlet according to claim 1, wherein said shaped hot air inlet comprises:
   - a star shaped hot air inlet; and
   - a diamond shaped hot air inlet situated proximate to the star shaped hot air inlet; and said shaped hot air outlet comprises:
   - a star shaped hot air outlet; and a diamond shaped hot air outlet situated proximate to the star shaped hot air outlet.

8. A modified shaped heat exchanger inlet and outlet comprising:

a hot side of said heat exchanger configured to flow hot air from a hot air inlet through heat transfer channels to a hot air outlet;

a first manifold surrounding said hot air inlet forming a first cavity and a second manifold surrounding said hot air outlet forming a second cavity;

a cold side of said heat exchanger including cold side heat transfer passageways thermally coupled to said heat transfer channels, said cold side heat transfer passageways configured to flow cold air over said heat transfer channels; and a shaped inlet at said hot air inlet and a shaped outlet at said hot air outlet, said shaped inlet and said shaped outlet being configured to align vertices with thermal load directions responsive to a thermal expansion mismatch between the hot air inlet and the first manifold and hot air outlet and the second manifold.

9. The modified shaped heat exchanger inlet and outlet according to claim 8, further comprising:

a first hot side transition region between said hot air inlet and heat transfer channels; and a second hot side transition region between said hot air outlet and said heat transfer channels.

10. The modified shaped heat exchanger inlet and outlet according to claim 8, wherein said shaped hot air inlet comprises at least one of a star shaped and diamond shaped hot air inlet and said shaped hot air outlet comprises at least one of a star shaped and a diamond shaped hot air outlet.

11. The modified shaped heat exchanger inlet and outlet according to claim 10, wherein said star shape is configured to align secondary vertices with the thermal load direction in a corner of the heat exchanger; and wherein said star shape is configured to align primary vertices with the thermal load direction at a center of the first manifold wall and with the thermal load direction at a center of the second manifold wall.

12. The modified shaped heat exchanger inlet and outlet according to claim 10, further comprising:

a diamond shaped inlet situated proximate the star shaped inlet, and a diamond shaped outlet situated proximate the star shaped outlet.

13. The modified shaped heat exchanger inlet and outlet according to claim 8, wherein a star shaped inlet at said hot air inlet and a star shaped outlet at said hot air outlet, are configured to align flexible vertices, including primary vertices and secondary vertices, with the thermal load directions thereby enabling the first cavity and second cavity to distort, changing the shape of the first cavity and the second cavity.

14. A process for creating a flexible heat exchanger inlet and outlet comprising:

surrounding a hot air inlet with a first manifold;

surrounding a hot air outlet with a second manifold;

forming an array of shaped inlets at said hot air inlet;

forming an array of shaped outlets at said hot air outlet; and aligning a vertices direction of said shaped inlets and said shaped outlets with a thermal load direction, said thermal load being responsive to a thermal expansion mismatch between the hot air inlet and the first manifold and a thermal expansion mismatch between the hot air outlet and the second manifold.

15. The process of claim 14, wherein the array of shaped inlets at said hot air inlet comprises at least one of a star shaped and diamond shaped hot air inlet; and said array of shaped outlets at said hot air outlet comprises at least one of a star shaped and a diamond shaped hot air outlet.

16. The process of claim 14, further comprising:

coupling a first hot side transition region between said hot air inlet and heat transfer channels; and coupling a second hot side transition region between said hot air outlet and said heat transfer channels.

17. The process of claim 14, further comprising:

aligning secondary vertices with the thermal load directions in a corner of the heat exchanger.

18. The process of claim 14, further comprising:

forming at least one star shaped inlet within the array of shaped inlets;

forming at least one star shaped outlet within the array of shaped outlets;

forming at least one diamond shaped inlet proximate the at least one star shaped inlet; and forming at least one diamond shaped outlet proximate the at least one star shaped outlet.

19. The process of claim 14, further comprising:

aligning primary vertices with the thermal load directions.

20. The process of claim 19, further comprising:

changing the shape of a first cavity formed by the first manifold surrounding said hot air inlet by allowing the first cavity to distort while said vertices align with said thermal load directions; and changing the shape of a second cavity formed by the second manifold surrounding said hot air outlet by allowing the second cavity to distort while said vertices align with said thermal load directions.

* * * * *